US011124956B2

(12) United States Patent
Momoe et al.

(10) Patent No.: US 11,124,956 B2
(45) Date of Patent: Sep. 21, 2021

(54) FLUSH TOILET

(71) Applicant: TOTO LTD., Kitakyushu (JP)

(72) Inventors: Masaaki Momoe, Kitakyushu (JP); Shu Kashirajima, Kitakyushu (JP); Satoshi Takano, Kitakyushu (JP); Masaki Mori, Kitakyushu (JP)

(73) Assignee: TOTO LTD., Kitakyushu (JP)

( * ) Notice: Subject to any disclaimer, the term of this patent is extended or adjusted under 35 U.S.C. 154(b) by 0 days.

(21) Appl. No.: 16/822,537

(22) Filed: Mar. 18, 2020

(65) Prior Publication Data

US 2020/0378102 A1 Dec. 3, 2020

(30) Foreign Application Priority Data

May 27, 2019 (JP) ..... JP2019-098521

(51) Int. Cl.
*E03D 11/08* (2006.01)

(52) U.S. Cl.
CPC ..... *E03D 11/08* (2013.01)

(58) Field of Classification Search
CPC ..... E03D 11/08; E03D 11/02
USPC ..... 4/420
See application file for complete search history.

(56) References Cited

U.S. PATENT DOCUMENTS 4,930,167 A * 6/1990 Ament ..... E03D 11/08 4/420
2007/0061955 A1* 3/2007 Asada ..... E03D 11/08 4/425
2020/0063418 A1 2/2020 Mori et al.

FOREIGN PATENT DOCUMENTS

JP 6332606 B2 5/2018
JP 2020-33701 A 3/2020

* cited by examiner

*Primary Examiner* — Lauren A Crane
(74) *Attorney, Agent, or Firm* — BakerHostetler

(57) ABSTRACT

The water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other side. The water supply portion is located at a position on the one side. The flush water is supplied to the water supply portion in a direction from the water supply portion toward the first water-guiding portion. A collision wall is provided on a way of the first water-guiding portion such that at least a part of the supplied flush water collides with the collision wall. The at least part of the flush water having collided with the collision wall is supplied to the second water-guiding portion.

10 Claims, 6 Drawing Sheets

FLUSH TOILET

TECHNICAL FIELD

The present invention pertains to a flush toilet, and more particularly to a flush toilet for flushing a toilet main unit with flush water.

BACKGROUND ART

Conventionally, as set forth in JP-B-6332606, for example, a flush toilet has been known wherein the flush toilet comprises a bowl portion and a rim spout port configured to spout flush water along a rim portion and wherein the flush water spouted from the rim spout port along the rim portion performs a flush as it circulates (swirls) over the interior of the bowl portion.

More specifically, as described in JP-B-6332606, a water conduit for supplying the flush water to the rim spout port (and thus to the interior of the bowl portion) has a first water-guiding portion extending from a water supply portion (branch portion), where the flush water is supplied to the water conduit, toward one of right and left sides of the bowl portion, and a second water-guiding portion extending from the water supply portion (branch portion) toward the other of the right and left sides of the bowl portion. The water supply portion (branch portion) is located at a central position in the right and left direction with respect to the bowl portion.

Patent Document List

JP-B-6332606

SUMMARY OF INVENTION

Technical Problem

Recently, it has been studied to make a flush toilet more compact in order to improve the design quality thereof. For example, it has been studied to make a flush toilet more compact in the forth and back direction in order to achieve a flush toilet whose forward projection is smaller.

Conventionally, as described in JP-B-6332606, the water supply portion (branch portion) is located at a central position in the right and left direction with respect to the bowl portion. The inventors of the present invention have been studied to make a flush toilet more compact in the forth and back direction by shifting the water supply portion (branch portion) from the central position to a right-sided or left-sided position.

Earlier than the present patent application, the applicant filed another Japanese patent application No. 2018-158423. FIG. 10 corresponds to FIG. 5 of the earlier patent application, which is a plan view showing a main toilet unit of a flush toilet according to a third embodiment of the invention disclosed in the earlier patent application. In the flush toilet shown in FIG. 10, a buffer chamber, which allows flush water to temporarily stay, is used to achieve a suitable guidance of a flow direction of the flush water toward a water supply portion 170.

Specifically, the flush water is supplied to the water supply portion 170 by a water supply passage 191 extending in a direction inclined with respect to the front and back direction and intersected with the inside surface of the water supply portion 170 (as well as intersected with the outer peripheral surface of a bowl portion 108) as seen in plan view; and the water supply passage 191 is connected to a straight water supply tube 193 via a buffer chamber 192 which allows the flush water to temporarily stay. In the flush toilet shown in FIG. 10, an entrance of the water supply passage 191 is located in the flow direction of the flush water from the straight water supply tube 193 into the buffer chamber 192.

According to the flush toilet shown in FIG. 10, since the flush water is allowed to temporarily stay in the buffer chamber 192, effects caused by a direction in which the flush water is supplied from the water supply tube 193 into the buffer chamber 192 can be reduced, so that the flush water can be more precisely supplied to the water supply portion 170 along the direction of the water supply passage 191.

In addition, in the earlier patent application, another embodiment has been disclosed, in which provided is a wall that reduces the flow speed of the flush water at a position against a direction in which the flush water is supplied from the water supply tube 193 into the buffer chamber 192. FIG. 11 corresponds to FIG. 6 of the earlier patent application, which is a plan view showing a main toilet unit of a flush toilet according to such an embodiment (fourth embodiment of the invention disclosed in the earlier patent application). An inner wall surface of a wall 194 of the buffer chamber 192 is substantially perpendicular to the direction in which the flush water is supplied from the water supply tube 193 into the buffer chamber 192

According to the flush toilet shown in FIG. 11, since there is provided the wall 194 that reduces the flow speed of the flush water at a position against a direction in which the flush water is supplied from the water supply tube 193 into the buffer chamber 192, the effects caused by the direction in which the flush water is supplied from the water supply tube 193 into the buffer chamber 192 can be more reduced, so that the flush water can be much more precisely supplied to the water supply portion 170 along the direction of the water supply passage 191.

However, according to further study by the present inventors, it has been found out that the structure on an upstream side of the water supply portion 170, surrounded by a chain line in each of FIGS. 10 and 11, protrudes rearward with respect to a first water-guiding portion 161 and a second water-guiding portion 162 and thus the structure is likely to hang down (which requires specific measures not to hand down).

The present invention has been made under the above background. The object of the present invention is to provide a flush toilet whose size in a forth and back direction thereof can be made compact and whose structure on an upstream side of a water supply portion is not likely to hang down.

Solution to Problem

The present invention is a flush toilet including: a toilet main unit having a bowl portion; a water conduit formed in the toilet main unit and configured to supply flush water into the bowl portion; wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion; the water supply portion is located at a position on the one side of the right and left sides of the bowl portion; the flush water is supplied to the water supply portion in a direction from the water supply portion toward the first water-guiding portion; a collision wall is provided on a way of the first water-guiding portion such that at least a part of the flush water supplied from the water supply portion toward the first water-guiding portion collides with the collision wall; and the at least part of the flush water having collided with the collision wall is supplied to the second water-guiding portion.

According to the above feature, since the water supply portion is located at a right-sided or left-sided position in a right and left direction with respect to the bowl portion, the size of the flush toilet can be made compact in the forth and back direction. In addition, since the collision wall is provided on a way of the first water-guiding portion, a ratio (distribution ratio) between an amount of the flush water supplied to the first water-guiding portion (i.e., an amount of the flush water to be spouted from the first spout port) and an amount of the flush water supplied to the second water-guiding portion (i.e., an amount of the flush water to be spouted from the second spout port) can be adjusted to a desired value. In addition, in order to supply the flush water to the water supply portion, a straight nozzle or the like, which per se has been conventionally well known, can be adopted. Thus, the problem that the structure on the upstream side of the water supply portion may hang down is not raised.

For example, it is preferable that an amount of the flush water spouted from the first spout port is 60% to 90% of an amount of the flush water supplied from the water supply portion.

In addition, it is preferable that the collision wall extends from a ceiling surface to a bottom surface of the first water-guiding portion. In this case, the collision wall and the at least part of the flush water toward the first water-guiding portion are more surely collided with each other, so that the at least part of the flush water having collided with the collision wall is more surely supplied to the second water-guiding portion.

In addition, it is preferable that the collision wall is provided such that a whole projected area of the water supply portion in a direction in which the flush water is supplied from the water supply portion overlaps with the collision wall. In this case as well, the collision wall and the at least part of the flush water toward the first water-guiding portion are more surely collided with each other, so that the at least part of the flush water having collided with the collision wall is more surely supplied to the second water-guiding portion. In addition, in this case, it is further preferable that the collision wall is in contact with an inside surface of the first water-guiding portion and away from an outside surface of the first water-guiding portion. According to this feature, both of water-guidance toward the first water-guiding portion and water-guidance toward the second water-guiding portion can be achieved more smoothly.

Alternatively, the present invention is a flush toilet including: a toilet main unit having a bowl portion; a water conduit formed in the toilet main unit and configured to supply flush water into the bowl portion; wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion and more rearward than the first spout port, the water supply portion is located at a position on the one side of the right and left sides of the bowl portion, the flush water is supplied to the water supply portion in a direction from the water supply portion toward the second water-guiding portion, a collision wall is provided on a way of the second water-guiding portion such that at least a part of the flush water supplied from the water supply portion toward the second water-guiding portion collides with the collision wall, and the at least part of the flush water having collided with the collision wall is supplied to the first water-guiding portion.

According to the above feature, since the water supply portion is located at a right-sided or left-sided position in a right and left direction with respect to the bowl portion, the size of the flush toilet can be made compact in the forth and back direction. In addition, since the collision wall is provided on a way of the second water-guiding portion, a ratio (distribution ratio) between an amount of the flush water supplied to the first water-guiding portion (i.e., an amount of the flush water to be spouted from the first spout port) and an amount of the flush water supplied to the second water-guiding portion (i.e., an amount of the flush water to be spouted from the second spout port) can be adjusted to a desired value. In addition, in order to supply the flush water to the water supply portion, a straight nozzle or the like, which per se has been conventionally well known, can be adopted. Thus, the problem that the structure on the upstream side of the water supply portion may hang down is not raised.

In the present feature as well, for example, it is preferable that an amount of the flush water spouted from the first spout port is 60% to 90% of an amount of the flush water supplied from the water supply portion.

In addition, in the present feature, it is preferable that the collision wall extends from a ceiling surface to a bottom surface of the second water-guiding portion. In this case, the collision wall and the at least part of the flush water toward the second water-guiding portion are more surely collided with each other, so that the at least part of the flush water having collided with the collision wall is more surely supplied to the first water-guiding portion.

In addition, in the present feature, it is preferable that the collision wall is provided such that a whole projected area of the water supply portion in a direction in which the flush water is supplied from the water supply portion overlaps with the collision wall. In this case as well, the collision wall and the at least part of the flush water toward the second water-guiding portion are more surely collided with each other, so that the at least part of the flush water having collided with the collision wall is more surely supplied to the first water-guiding portion. In addition, in this case, it is further preferable that the collision wall is in contact with an inside surface of the second water-guiding portion and away from an outside surface of the second water-guiding portion. According to this feature, both of water-guidance toward the first water-guiding portion and water-guidance toward the second water-guiding portion can be achieved more smoothly.

Advantageous Effects of Invention

According to one feature of the present disclosure, since the water supply portion is located at a right-sided or left-sided position in a right and left direction with respect to the bowl portion, the size of the flush toilet can be made compact in the forth and back direction. In addition, since the collision wall is provided on a way of the first water-guiding portion, a ratio (distribution ratio) between an amount of the flush water supplied to the first water-guiding portion (i.e., an amount of the flush water to be spouted from the first spout port) and an amount of the flush water supplied to the second water-guiding portion (i.e., an amount of the flush water to be spouted from the second spout port) can be adjusted to a desired value. In addition, in order to supply the flush water to the water supply portion, a straight nozzle or the like, which per se has been conventionally well known, can be adopted. Thus, the problem that the structure on the upstream side of the water supply portion may hang down is not raised.

According to another feature of the present disclosure, since the water supply portion is located at a right-sided or left-sided position in a right and left direction with respect to the bowl portion, the size of the flush toilet can be made compact in the forth and back direction. In addition, since the collision wall is provided on a way of the second water-guiding portion, a ratio (distribution ratio) between an amount of the flush water supplied to the first water-guiding portion (i.e., an amount of the flush water to be spouted from the first spout port) and an amount of the flush water supplied to the second water-guiding portion (i.e., an amount of the flush water to be spouted from the second spout port) can be adjusted to a desired value. In addition, in order to supply the flush water to the water supply portion, a straight nozzle or the like, which per se has been conventionally well known, can be adopted. Thus, the problem that the structure on the upstream side of the water supply portion may hang down is not raised.

DESCRIPTION OF EMBODIMENTS

First Embodiment

Figure 1:
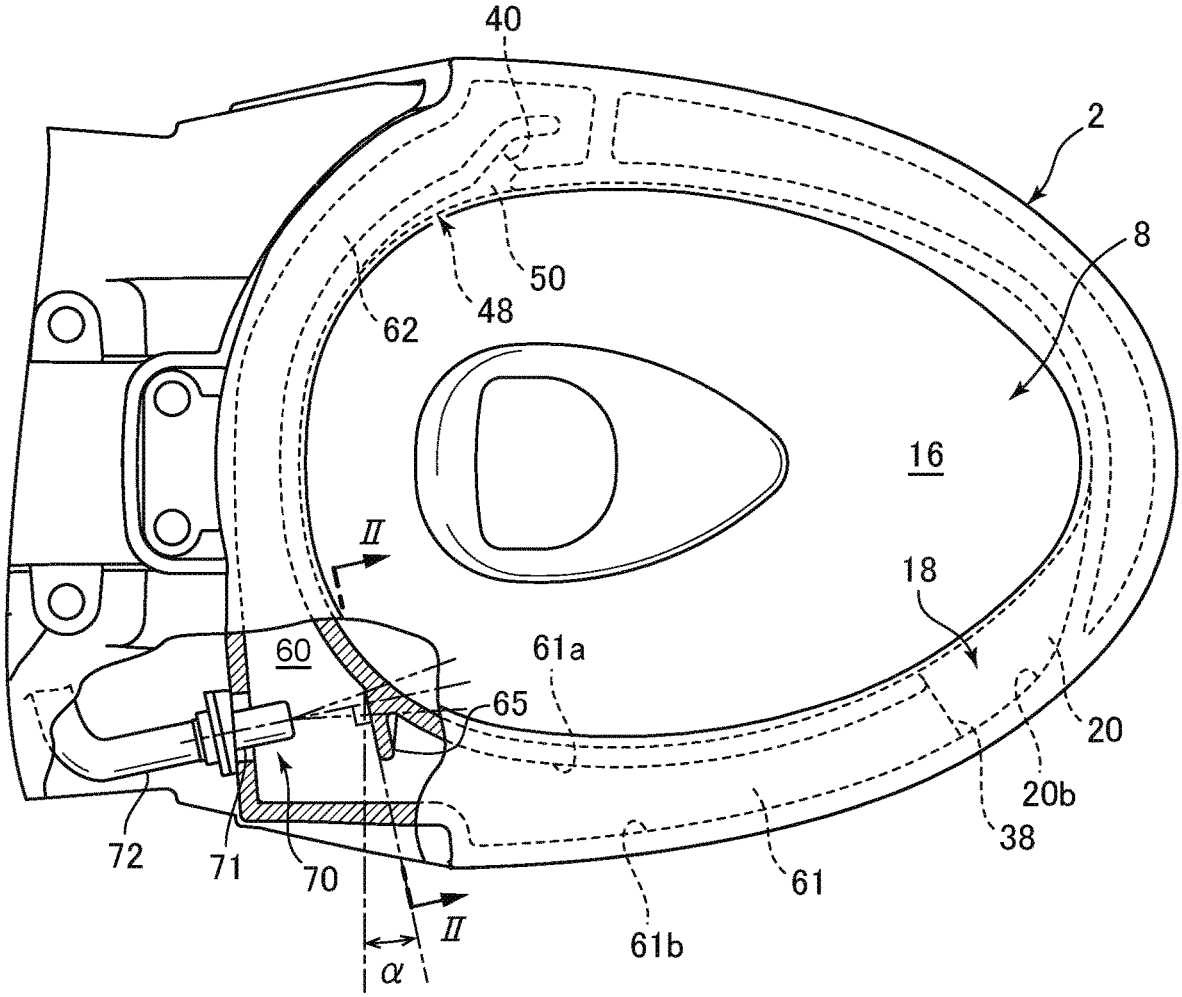
FIG. 1 is a plan view showing a main toilet unit of a flush toilet according to a first embodiment of the present invention.
Figure 2:
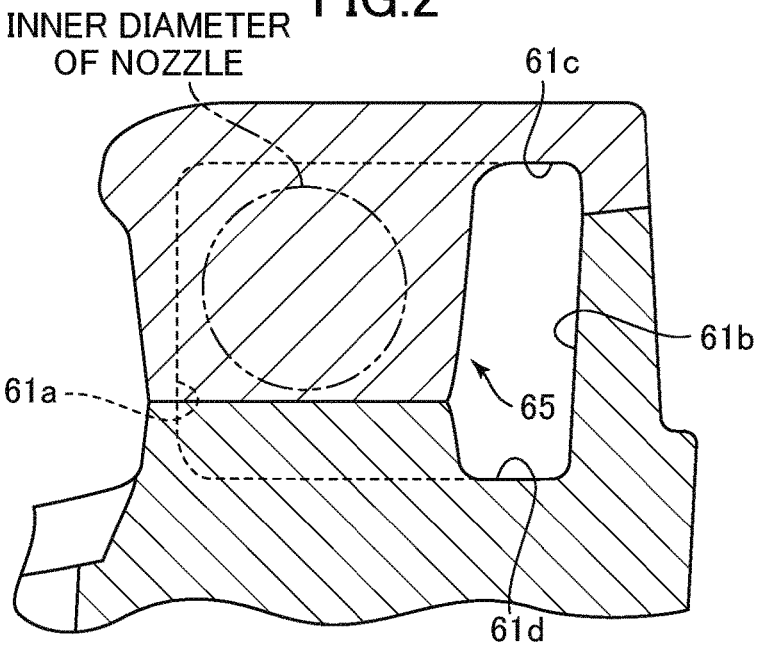
FIG. 2 is a cross section view taken along line II-II of FIG. 1.
Figure 3:
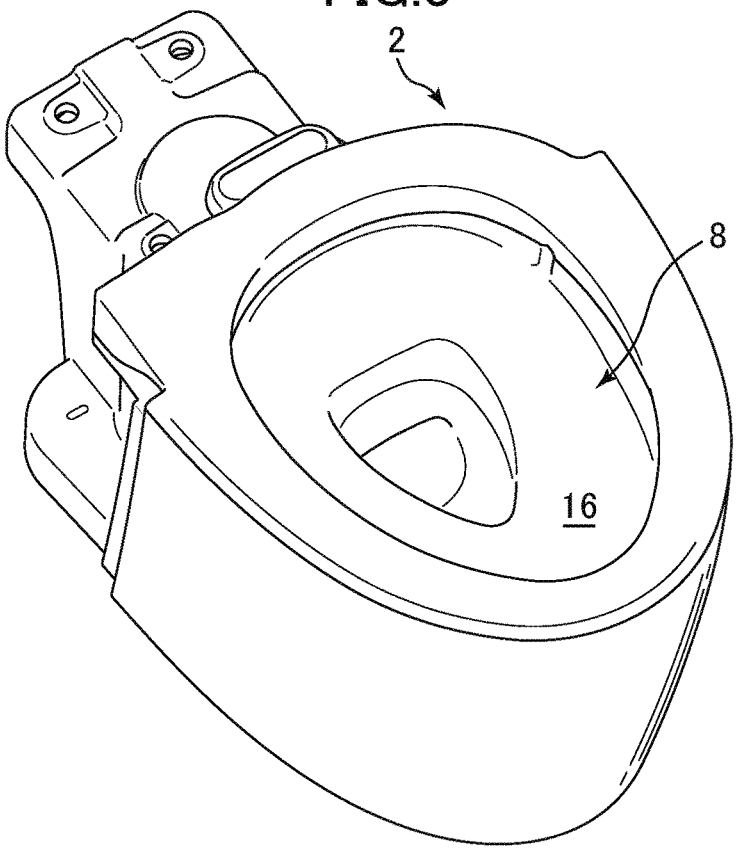
FIG. 3 is a front upper perspective view of the main toilet unit shown in FIG. 1.
Figure 4:
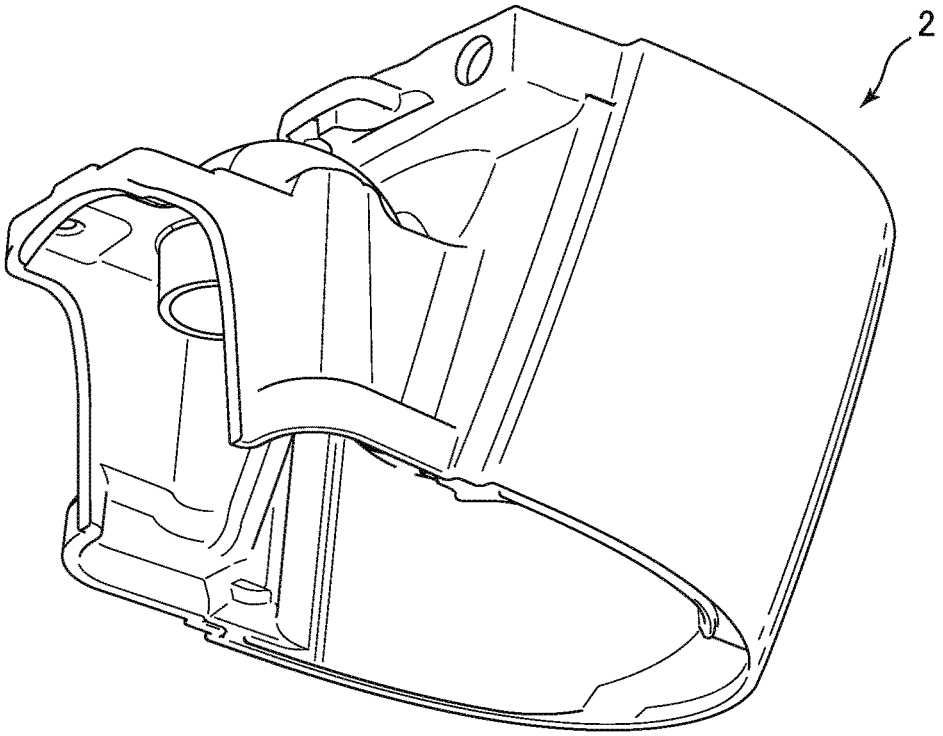
FIG. 4 is a rear lower perspective view of the main toilet unit shown in FIG. 1.

With reference to the attached drawings, we explain the flush toilet according to the first embodiment of the present invention. FIG. 1 is a plan view showing a main toilet unit of the flush toilet according to the first embodiment of the present invention, FIG. 2 is a cross section view taken along line II-II of FIG. 1, FIG. 3 is a front upper perspective view of the main toilet unit shown in FIG. 1, and FIG. 4 is a rear lower perspective view of the main toilet unit shown in FIG. 1.

It should be noted that any embodiment of the present invention will be described based on the following assumption: a "right side" is defined when viewing a toilet main unit 2 rearwardly from a front side thereof; and a "left side" is also defined when viewing the toilet main unit 2 rearwardly from the front side thereof.

As shown in FIGS. 1 to 4, the flush toilet 1 according to the first embodiment of the present invention has a toilet main unit 2 made of porcelain or the like. A water storage tank 4 as a flush water tank is provided on a rear portion of the toilet main unit 2. The water storage tank 4 is connected to a water supply source (not shown) such as a public water system.

A bowl portion 8 is formed on an upper side of a front portion of the main toilet unit 2. A water pooling region is formed at a lower part of the bowl portion 8, and a predetermined amount of water is pooled in the water pooling region. A lower end of the water pooling region is connected to an inlet of a discharge trap pipe. The discharge trap pipe extends rearward from the inlet thereof. A rear end of the discharge trap pipe is connected to a discharge pipe (not shown) provided under a floor surface.

Inside the main toilet unit 2, there is provided a water conduit 60 which is configured to guide the flush water supplied from the supply port provided on the rear side of the main toilet unit 2 toward the bowl portion 8.

The water conduit 60 has a first water-guiding portion 61 extending from a water supply portion 70, where the flush water is supplied to the water conduit 60, to a first spout port 38 located on the left side (on one of right and left sides) of the bowl portion 8, and a second water-guiding portion 62 extending from the water supply portion 70 to a second spout port 40 located on the right side (on the other of the right and left sides) of the bowl portion 8. In addition, as a feature of the present embodiment, the water supply portion 70 is located at a left-sided portion (either at a right-sided portion or at a left-sided position) in a right and left direction with respect to the bowl portion 8.

The first water-guiding portion 61 is formed to extend from the water supply portion 70 substantially toward the front portion of the main toilet unit 2. The second water-guiding portion 62 is formed to extend from the water supply portion 70 substantially toward a right side of the main toilet unit 2 and subsequently bend back to the second spout port 40.

The flush water is supplied to the water supply portion 70 toward the first water-guiding portion 61 in substantially a front and back direction as seen in a plan view (to be exact, in a direction inwardly inclined with respect to the front and back direction by a degrees (about 10 to 30 degrees)).

Correspondingly, according to the present embodiment, the flush water is supplied to the water supply portion 70 by means of a straight nozzle 71 which extends in substantially a front and back direction as seen in a plan view (to be exact, in a direction inwardly inclined with respect to the front and back direction by a degrees (about 10 to 30 degrees)). The straight nozzle 71 is connected to a water supply tube 72.

In addition, in the present embodiment, as shown in FIG. 1, the first water-guiding portion 61 and the second water-guiding portion 62 are smoothly continuous. At a portion where they are continuous (connected), the tangential direction of the first water-guiding portion 61 and the tangential direction of the second water-guiding portion 62 are substantially identical.

A collision wall 65 is provided on a way of the first water-guiding portion 61 such that at least a part of the flush water supplied from the water supply portion 70 toward the first water-guiding portion 61 collides with the collision wall 65. The at least part of the flush water having collided with the collision wall 65 is supplied toward the second water-guiding portion 62.

The collision wall 65 of the present embodiment is located at a position close to the water supply portion 70. As shown in FIG. 1, the collision wall 65 is provided perpendicularly to a direction in which the straight nozzle 71 extends (i.e., a direction in which the flush water is supplied to the water supply portion 70). The collision wall 65 is separated from an outside surface 61*b* of the first water-guiding portion 61. The width of the separation is about 25% to 40%, for example about one third, of the width of the first water-guiding portion 61 without the collision wall 65 (shown in a broken line in FIG. 2).

In addition, as shown in FIG. 2, the size and orientation of the collision wall 65 of the present embodiment are determined in such a manner that a whole projected area of the water supply portion 70 (a whole projected area of an inner diameter of the straight nozzle 71) in a direction in which the flush water is supplied from the water supply portion 70 overlaps with the collision wall 65. In addition, the collision wall 65 of the present embodiment extends from a ceiling surface 61*c* to a bottom surface 61*d* of the first water-guiding portion 61.

In addition, by adjusting an orientation of the straight nozzle 71 within a range of ±15 degrees in a plan view, with respect to a central axis of the straight nozzle 71 shown in FIG. 1 (orthogonally intersected with the collision wall 65) as a standard axis, it is possible to adjust a ratio (distribution ratio) between an amount of the flush water supplied to the first water-guiding portion 61 (i.e., an amount of the flush water to be spouted from the first spout port 38) and an amount of the flush water supplied to the second water-guiding portion 62 (i.e., an amount of the flush water to be spouted from the second spout port 40) to 60 to 90%:40 to 10% (for example, 80%:20%).

Besides, the bowl portion 8 has a waste receiving surface 16 formed in a bowl shape, and a first and second shelf 18, 48 formed at an upper part of the bowl portion 8 and configured to guide the flush water toward the waster receiving surface 16.

More specifically, the first shelf 18 is located at an upper part of a front region of the waste receiving surface 16, and a first water-passage 20 is formed on the first shelf 18. The flush water spouted onto the first water-passage 20 is adapted to flow (turn) from a left side to a right side of the front region of the bowl portion 8, and then to the rearward of the bowl portion 8.

In addition, in the present embodiment, in a transition region where the first water-guiding portion 61 and the first water passage 20 are connected, an outside surface 61*b* of the first water-guiding portion 61 and an outer wall surface 20*b* of the first water passage 20 are continuously formed substantially in a flat manner. Thereby, the flush water can smoothly flow from the first water-guiding portion 61 to the first water passage 20.

In addition, in the present embodiment, in a vicinity of the first spout port 38, a direction in which a central axis of the first water-guiding portion 61 extends and a flow direction of the flush water that goes along the first water passage 20 are substantially identical. Thereby, the flush water spouted from the first spout port 38 flows in substantially the same direction on the first water passage 20, and thus can flow with its power substantially maintained (with the flow amount and the flow speed substantially maintained).

The second shelf 48 is located at an upper part of a rear region of the waste receiving surface 16, and a second water-passage 50 is formed on the second shelf 48. The flush water spouted onto the second water-passage 50 is adapted to flow (turn) from a right side to a left side of the rear region of the bowl portion 8, and then to the forward of the bowl portion 8.

In addition, in the present embodiment, the flush water spouted from the second spout port 40 flows in substantially the same direction on the second water passage 50, and thus can flow with its power substantially maintained (with the flow amount and the flow speed substantially maintained).

Next, an operation (action) of the flush toilet according to the present embodiment is explained.

In order to perform a flush, the operation lever or button (not shown) in an operation panel (not shown) is operated so that the discharge valve (not shown) provided in the water storage tank is opened. Then, a predetermined amount of the flush water (for example, 4.8 liters) is supplied from the water storage tank into the main toilet unit 2 through the supply port (not shown) provided on the rear side of the main toilet unit 2. More specifically, the flush water is supplied into the water conduit 60 through the water supply tube 72 and the straight nozzle 71.

Subsequently, a part of the flush water supplied from the water supply portion 70 toward the first water-guiding portion 61 collides with the collision wall 65, so that the flush water is divided into the first water-guiding portion 61 and the second water-guiding portion 62.

In the present embodiment, the ratio (distribution ratio) between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) is adjusted to be 60 to 90%:40 to 10% (for example, 80%:20%).

The flush water spouted from the first spout port 38 through the first water-guiding portion 61 flows on the first water passage 20, and swirls down toward the waste receiving surface 16 while washing the bowl portion 8.

The flush water spouted from the second spout port 40 through the second water-guiding portion 62 flows on the second water passage 50, and swirls down toward the waste receiving surface 16 while washing the bowl portion 8.

The flush water that has swirled down while washing the bowl portion 8 is discharged from the discharge trap pipe 14 together with waste. Then, a sequence of flush operations for the main toilet unit 2 is completed.

According to the flush toilet 1 of the present embodiment as described above, since the water supply portion 70 is located at the left-sided position (either at a right-sided portion or at a left-sided position) in the right and left direction with respect to the bowl portion 8, the size of the flush toilet 1 can be made compact in the forth and back direction.

In addition, since the collision wall 65 is provided on the way of the first water-guiding portion 61, the ratio (distribution ratio) between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) can be adjusted to a desired value.

In addition, in order to supply the flush water to the water supply portion 70, the straight nozzle 71, which per se has been conventionally well known, can be adopted. Thus, as shown in FIGS. 3 and 4, the problem that the structure on the upstream side of the water supply portion 70 may hang down is not raised. FIGS. 3 and 4 show a status before the straight nozzle 71 and the water supply tube 72 are attached.

In addition, according to the flush toilet 1 of the present embodiment, the collision wall 65 extends from the ceiling surface 61*c* to the bottom surface 61*d* of the first water-guiding portion 61. Thus, the collision wall 65 and the at least part of the flush water toward the first water-guiding portion 61 are more surely collided with each other, so that the at least part of the flush water having collided with the collision wall 65 is more surely supplied to the second water-guiding portion 62.

In addition, according to the flush toilet 1 of the present embodiment, the whole projected area of the water supply portion 70 in the direction in which the flush water is supplied from the water supply portion 70 overlaps with the collision wall 65. Hereby too, the collision wall 65 and the at least part of the flush water toward the first water-guiding portion 61 are more surely collided with each other, so that the at least part of the flush water having collided with the collision wall 65 is more surely supplied to the second water-guiding portion 62.

Furthermore, according to the flush toilet 1 of the present embodiment, the collision wall 65 is in contact with the inside surface 61*a* of the first water-guiding portion 61 and away from the outside surface 61*b* of the first water-guiding portion 61. Thus, both of water-guidance toward the first water-guiding portion 61 and water-guidance toward the second water-guiding portion 62 can be achieved more smoothly.

<Variations>

In the above embodiment, the collision wall 65 extends from the ceiling surface 61*c* to the bottom surface 61*d* of the first water-guiding portion 61. However, the collision wall 65 may be provided only on a side of the ceiling surface 61*c* or only on a side of the bottom surface 61*d* of the first water-guiding portion 61.

Figure 5:
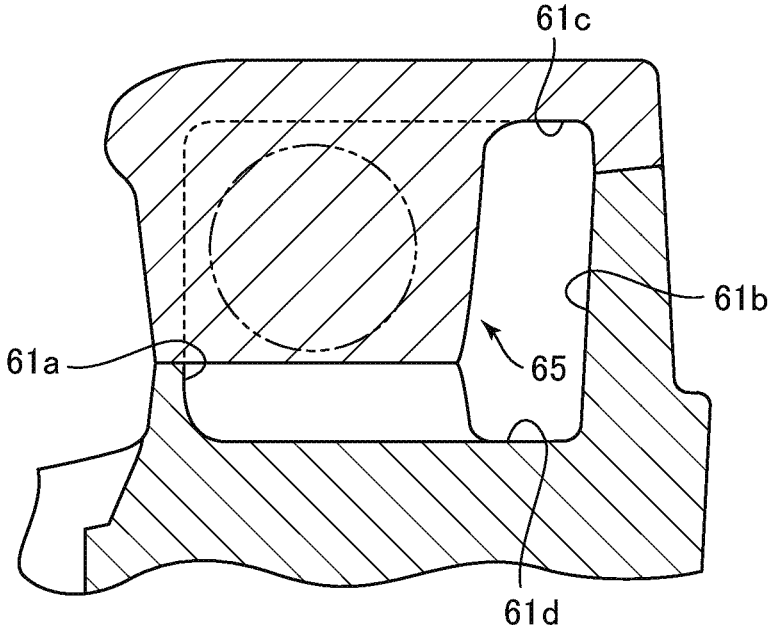
FIG. 5 is a view corresponding to FIG. 2 showing a first variation of the collision wall.

For example, the collision wall 65 may be provided only on a side of the ceiling surface 61*c* of the first water-guiding portion 61 and away from the bottom surface 61*d* of the first water-guiding portion 61. Such a variation is shown in FIG. 5 which corresponds to FIG. 2.

Figure 6:
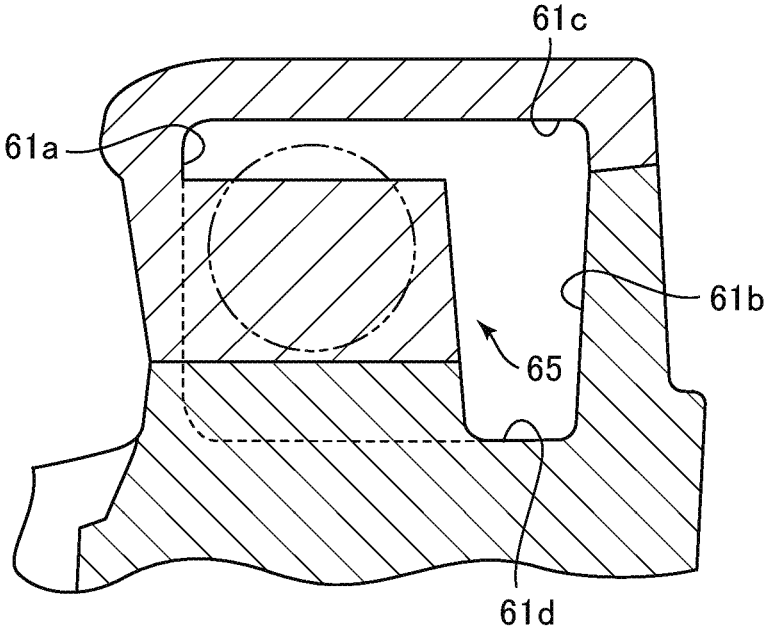
FIG. 6 is a view corresponding to FIG. 2 showing a second variation of the collision wall.

Alternatively, the collision wall 65 may be provided only on a side of the bottom surface 61*d* of the first water-guiding portion 61 and away from the ceiling surface 61*c* of the first water-guiding portion 61. Such a variation is shown in FIG. 6 which corresponds to FIG. 2. In this variation, the whole projected area of the water supply portion 70 in the direction in which the flush water is supplied from the water supply portion 70 does not overlap with the collision wall 65. Only a part of the projected area of the water supply portion 70 overlaps with the collision wall 65.

Figure 7:
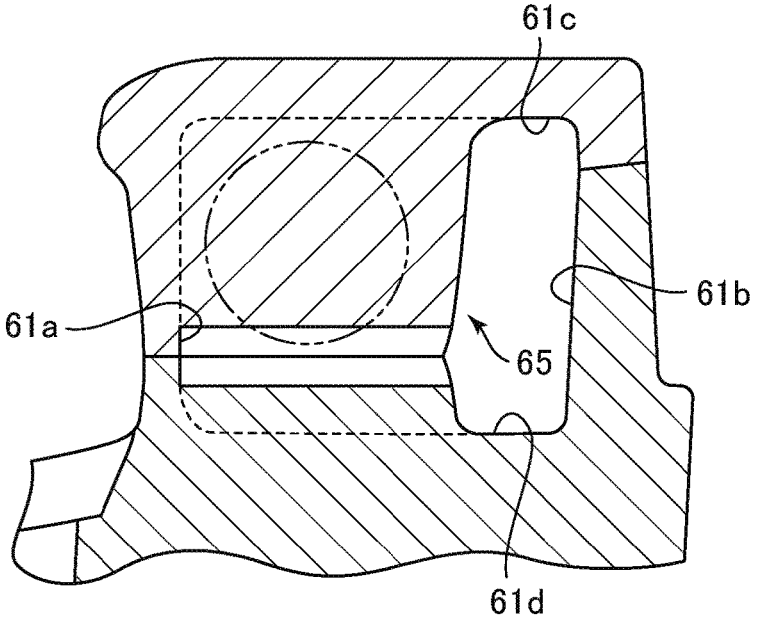
FIG. 7 is a view corresponding to FIG. 2 showing a third variation of the collision wall.

Alternatively, the collision wall 65 may be separately provided on a side of the ceiling surface 61*c* of the first water-guiding portion 61 and on a side of the bottom surface 61*d* of the first water-guiding portion 61 with a gap therebetween. Such a variation is shown in FIG. 7 which corresponds to FIG. 2. In this variation as well, the whole projected area of the water supply portion 70 in the direction in which the flush water is supplied from the water supply portion 70 does not overlap with the collision wall 65. Only a part of the projected area of the water supply portion 70 overlaps with the collision wall 65.

Figure 8:
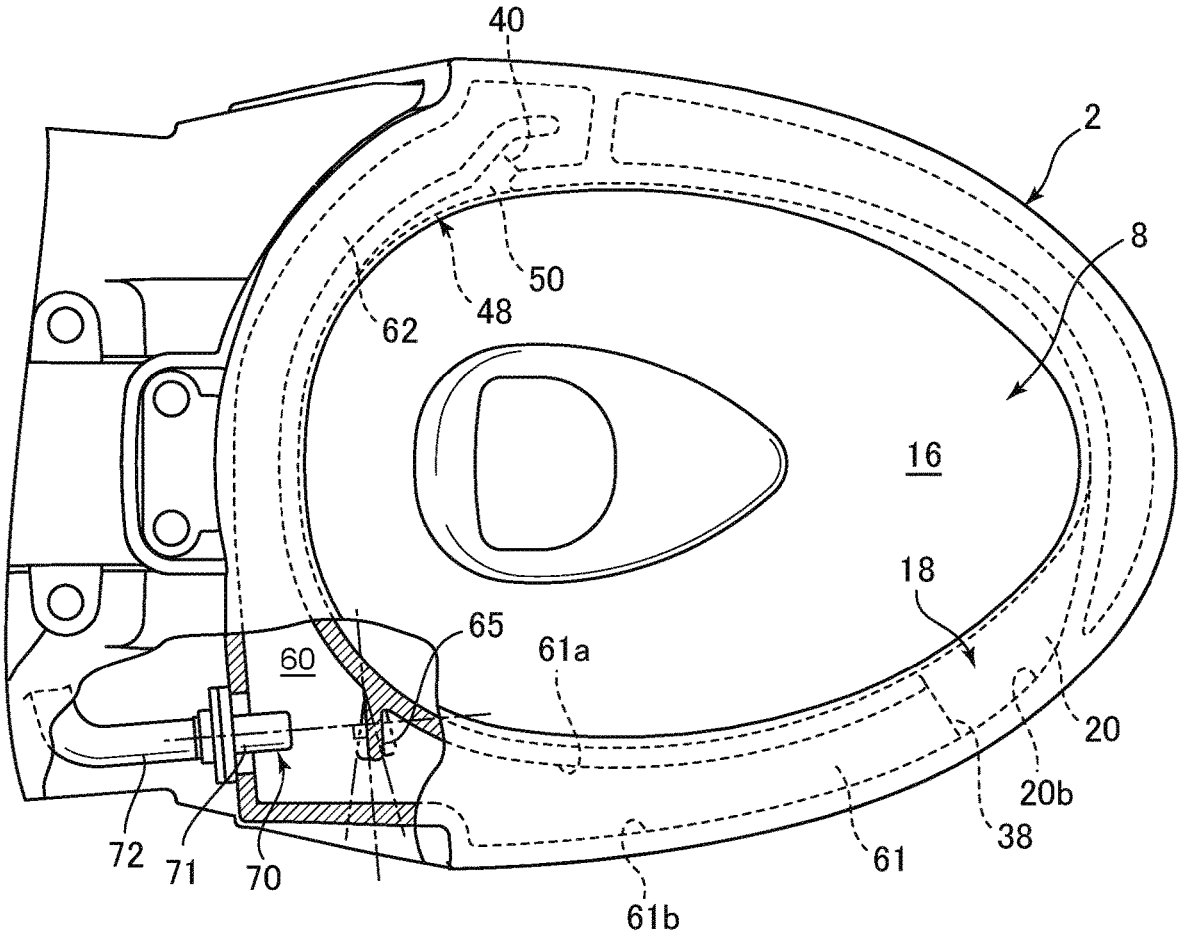
FIG. 8 is a view corresponding to FIG. 1 showing variations of an extending angle of the collision wall.

Furthermore, in the above embodiment and the above variations, the direction in which the collision wall 65 extends is perpendicular to the direction in which the straight nozzle 71 extends (i.e., the direction in which the flush water is supplied to the water supply portion 70). However, as shown in FIG. 8, by adjusting an orientation (extending angle) of the collision wall 65 within a range of ±20 degrees in a plan view, the ratio (distribution ratio) between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) is adjusted to be 60 to 90%:40 to 10% (for example, 80%:20%).

As described above, the size, the location and the extending direction of the collision wall 65 may be variously changed. They are suitably adjusted in order to set the ratio between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) to be 60 to 90%:40 to 10% (for example, 80%:20%), and in order to maintain the power of the flush water toward the first water-guiding portion 61 (to be spouted from the first spout port 38) and the power of the flush water toward the second water-guiding portion 62 (to be spouted from the second spout port 40) as much as possible.

In general, a collision surface of the collision wall 65 is a flat surface. However, it may be a slightly curved surface.

Second Embodiment

Figure 9:
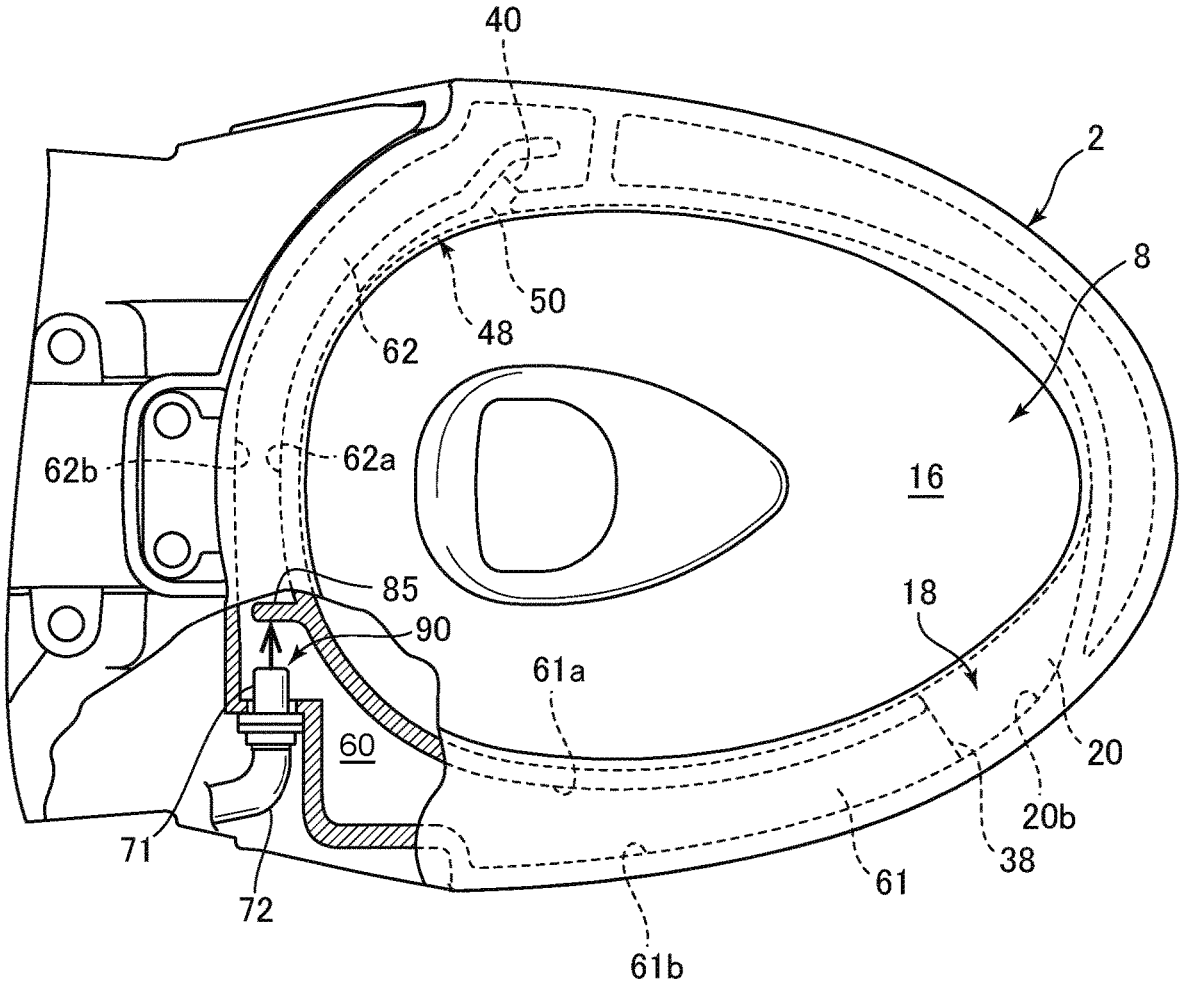
FIG. 9 is a plan view showing a main toilet unit of a flush toilet according to a second embodiment of the present invention.
Figure 10:
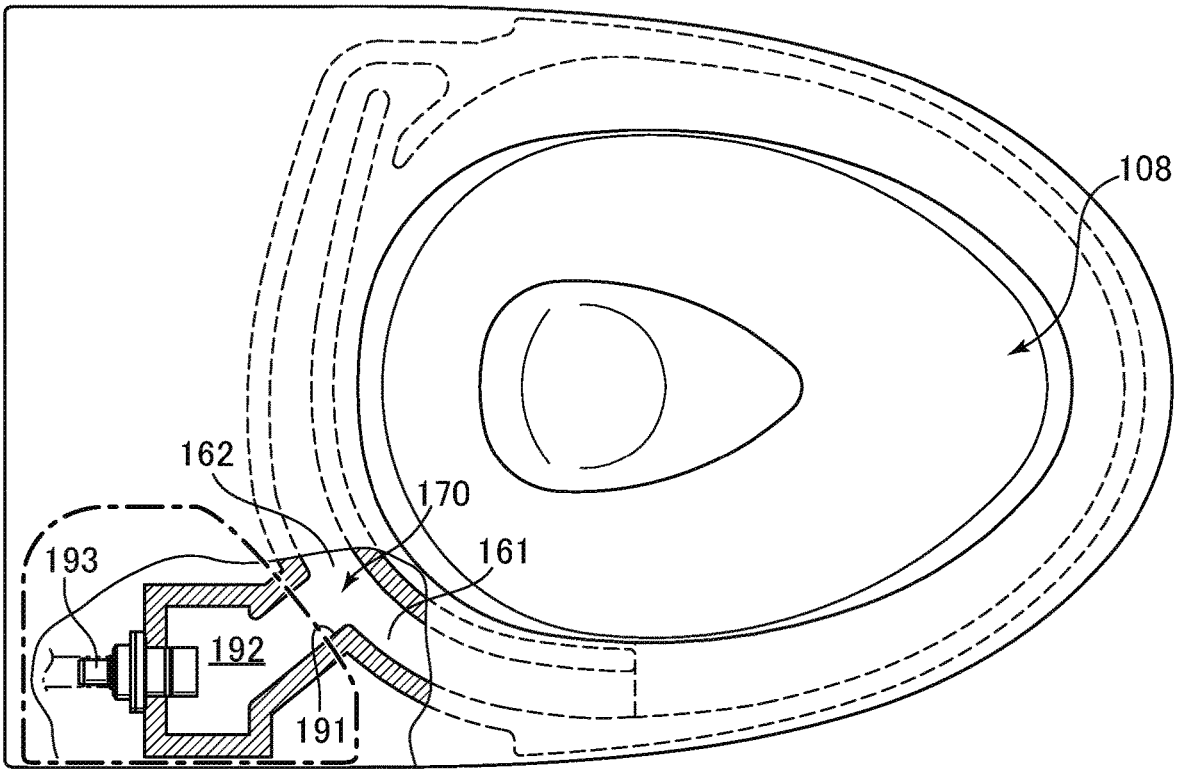
FIG. 10 is a plan view showing a main toilet unit of a flush toilet disclosed in the earlier patent application filed by the present applicant.
Figure 11:
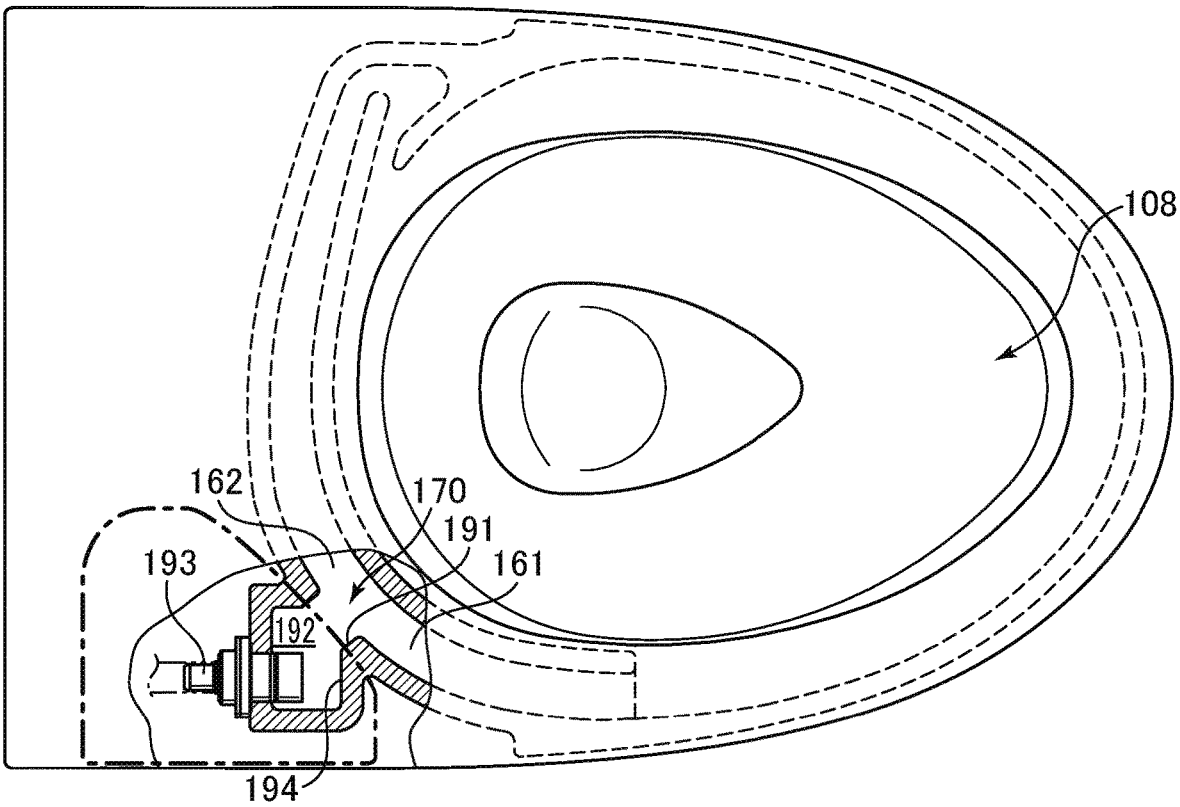
FIG. 11 is a plan view showing a main toilet unit of another flush toilet disclosed in the earlier patent application filed by the present applicant.

Next, FIG. 9 is a plan view showing a main toilet unit of a flush toilet according to a second embodiment of the present invention. In the second embodiment, a collision wall 85 is provided not on the way of the first water-guiding portion 61, but on a way of the second water-guiding portion 62. The flush water is supplied to the water supply portion 90 toward the second water-guiding portion 62 in substantially a right and left direction as seen in a plan view. At least a part of the flush water having collided with the collision wall 85 is supplied toward the first water-guiding portion 61.

The collision wall 85 of the present embodiment is located at a position close to the water supply portion 90. As shown in FIG. 9, the collision wall 85 extends out from an inside surface 62*a* of the second water-guiding portion 62 in a front and back direction. The collision wall 85 is separated from an outside surface 62*b* of the second water-guiding portion 62.

In addition, as shown in FIG. 9, the size and orientation of the collision wall 85 of the present embodiment are determined in such a manner that a whole projected area of the water supply portion 90 (a whole projected area of an inner diameter of the straight nozzle 71) in a direction in which the flush water is supplied from the water supply portion 90 overlaps with the collision wall 85. In addition, the collision wall 85 of the present embodiment extends from a ceiling surface to a bottom surface of the second water-guiding portion 62.

The other structure of the second embodiment is substantially the same as the first embodiment explained with reference to FIGS. 1-4. In FIG. 9, the same portions as those of the first embodiment are shown by the same reference numerals, and detailed explanation thereof is omitted.

According to the present embodiment, since the water supply portion 90 is located at the left-sided position (either at a right-sided portion or at a left-sided position) in the right and left direction with respect to the bowl portion 8, the size of the flush toilet 1 can be made compact in the forth and back direction.

In addition, since the collision wall 85 is provided on the way of the second water-guiding portion 62, the ratio (distribution ratio) between the amount of the flush water supplied to the first water-guiding portion 61 (i.e., the amount of the flush water to be spouted from the first spout port 38) and the amount of the flush water supplied to the second water-guiding portion 62 (i.e., the amount of the flush water to be spouted from the second spout port 40) can be adjusted to a desired value.

In addition, in order to supply the flush water to the water supply portion 90, the straight nozzle 71, which per se has been conventionally well known, can be adopted. Thus, the problem that the structure on the upstream side of the water supply portion 90 may hang down is not raised.

In addition, according to the flush toilet 1 of the present embodiment, the collision wall 85 extends from the ceiling surface to the bottom surface of the second water-guiding portion 62. Thus, the collision wall 85 and the at least part of the flush water toward the second water-guiding portion 62 are more surely collided with each other, so that the at least part of the flush water having collided with the collision wall 85 is more surely supplied to the first water-guiding portion 61.

In addition, according to the flush toilet 1 of the present embodiment, the whole projected area of the water supply portion 90 in the direction in which the flush water is supplied from the water supply portion 90 overlaps with the collision wall 85. Hereby too, the collision wall 85 and the at least part of the flush water toward the second water-guiding portion 62 are more surely collided with each other, so that the at least part of the flush water having collided with the collision wall 85 is more surely supplied to the first water-guiding portion 61.

Furthermore, according to the flush toilet 1 of the present embodiment, the collision wall 85 is in contact with the inside surface 62*a* of the second water-guiding portion 62 and away from the outside surface 62*b* of the first water-guiding portion 62. Thus, both of water-guidance toward the first water-guiding portion 61 and water-guidance toward the second water-guiding portion 62 can be achieved more smoothly.

What is claimed is:

1. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion, the water supply portion is located at a position on the one side of the right and left sides of the bowl portion, the flush water is supplied to the water supply portion in a direction from the water supply portion toward the first water-guiding portion, a collision wall is provided on a way of the first water-guiding portion such that at least a part of the flush water supplied from the water supply portion toward the first water-guiding portion collides with the collision wall, and the at least part of the flush water having been supplied toward the first water-guiding portion but having been collided with the collision wall is supplied to the second water-guiding portion.

2. The flush toilet according to claim 1, wherein an amount of the flush water spouted from the first spout port is 60% to 90% of an amount of the flush water supplied from the water supply portion.

3. The flush toilet according to claim 1, wherein the collision wall extends from a ceiling surface to a bottom surface of the first water-guiding portion.

4. The flush toilet according to claim 1, wherein the collision wall is provided such that a whole projected area of the water supply portion in a direction in which the flush water is supplied from the water supply portion overlaps with the collision wall.

5. The flush toilet according to claim 4, wherein the collision wall is in contact with an inside surface of the first water-guiding portion and away from an outside surface of the first water-guiding portion.

6. A flush toilet comprising:

a toilet main unit having a bowl portion, a water conduit formed in the toilet main unit and configured to supply flush water into the bowl portion, wherein the water conduit has: a first water-guiding portion extending from a water supply portion, where the flush water is supplied to the water conduit, to a first spout port located on one of right and left sides of the bowl portion; and a second water-guiding portion extending from the water supply portion to a second spout port located on the other of the right and left sides of the bowl portion and more rearward than the first spout port, the water supply portion is located at a position on the one side of the right and left sides of the bowl portion, the flush water is supplied to the water supply portion in a direction from the water supply portion toward the second water-guiding portion, a collision wall is provided on a way of the second water-guiding portion such that at least a part of the flush water supplied from the water supply portion toward the second water-guiding portion collides with the collision wall, and the at least part of the flush water having been supplied toward the second water-guiding portion but having been collided with the collision wall is supplied to the first water-guiding portion.

7. The flush toilet according to claim 6, wherein an amount of the flush water spouted from the first spout port is 60% to 90% of an amount of the flush water supplied from the water supply portion.

8. The flush toilet according to claim 6, wherein the collision wall extends from a ceiling surface to a bottom surface of the second water-guiding portion.

9. The flush toilet according to claim 6, wherein the collision wall is provided such that a whole projected area of the water supply portion in a direction in which the flush water is supplied from the water supply portion overlaps with the collision wall.

10. The flush toilet according to claim 9, wherein the collision wall is in contact with an inside surface of the second water-guiding portion and away from an outside surface of the second water-guiding portion.

* * * * *